United States Patent [19]

Shibata et al.

[11] Patent Number: 4,725,209

[45] Date of Patent: Feb. 16, 1988

[54] DISTRIBUTOR TYPE FUEL INJECTION PUMP

[75] Inventors: Akira Shibata, Anjo; Shizuo Kawai; Yukinori Miyata, both of Kariya, Japan

[73] Assignee: Nippondenso Co., Ltd., Kariya, Japan

[21] Appl. No.: 10,845

[22] Filed: Feb. 4, 1987

[30] Foreign Application Priority Data

Feb. 6, 1986 [JP] Japan ..... 61-24515

[51] Int. Cl.[4] ..... F04B 19/22; F04B 29/00; F02M 41/14

[52] U.S. Cl. ..... 417/462; 123/450

[58] Field of Search ..... 417/252, 462; 123/450, 123/500, 501

[56] References Cited

U.S. PATENT DOCUMENTS

| | | | |
|---|---|---|---|
| 3,035,523 | 5/1962 | Kemp et al. | 123/450 |
| 3,099,219 | 7/1963 | Bessiere . | |
| 3,101,079 | 8/1963 | Evans . | |
| 4,445,822 | 5/1984 | Hoshi | 417/462 |
| 4,450,813 | 5/1984 | Takano | 417/462 |
| 4,458,649 | 7/1984 | Takahashi | 123/450 |
| 4,492,200 | 1/1985 | Takahashi | 417/462 |
| 4,517,946 | 5/1985 | Takano | 417/462 |

FOREIGN PATENT DOCUMENTS

| | | | |
|---|---|---|---|
| 58-35260 | 2/1983 | Japan . | |
| 870383 | 6/1961 | United Kingdom . | |
| 972446 | 10/1964 | United Kingdom . | |
| 2078871 | 1/1982 | United Kingdom | 123/450 |

*Primary Examiner*—William L. Freeh

*Attorney, Agent, or Firm*—Cushman, Darby & Cushman

[57] ABSTRACT

A distributor type fuel injection pump of the invention includes a rotor, a pair of plungers reciprocated in the rotor, the pair of plungers defining a pump chamber therebetween; a shuttle cylinder; a shuttle piston, movably located in the shuttle cylinder, for dividing the interior of the shuttle cylinder into first and second pressure chambers, the second pressure chamber being always connected to the pump chamber, thereby pressurizing the fuel in the second pressure chamber by pressurization of fuel in the pump chamber by the plungers and moving the shuttle piston to pressurize the fuel in the first pressure chamber; a distribution head for distributing and supplying the pressurized fuel in the first pressure chamber to each combustion chamber of the engine; a control rod for mechanically adjusting an initial position of the shuttle piston when the fuel is supplied to the first and second pressure chambers; and a spill hole for spilling the fuel in the second pressure chamber when the shuttle piston is moved from the initial position toward a final position by the pressure of the pressurized fuel in the second pressure chamber and reaches the final position.

7 Claims, 10 Drawing Figures

DISTRIBUTOR TYPE FUEL INJECTION PUMP

BACKGROUND OF THE INVENTION

The present invention relates to a distributor type fuel injection pump for distributing and supplying pressurized fuel to combustion chambers of an internal combustion engine and, more particularly, to an inner cam distributor type fuel injection pump, including a rotor which is rotatably driven, plungers disposed in the rotor to be slidable along the radial direction thereof, and a cam ring which is positioned to surround the rotor, and an inner surface of which is formed to be a cam surface to reciprocate the plungers along with rotation of the rotor, wherein fuel is drawn by reciprocation of the plungers in a pump chamber defined between the plungers, the fuel is pressurized, and then the pressurized fuel is distributed and supplied to each cylinder of the engine.

As a distributor type fuel injection pump of this type, the above-mentioned inner cam type fuel injection pump and a face cam type fuel injection pump are known. The face cam type fuel injection pump includes a plunger which is reciprocated to perform a pump action, and the plunger is reciprocated by cooperation of a face cam, which is rotated with the plunger, and cam rollers rotatably contacting the face cam. However, in this face cam type fuel injection pump, although the face cam is urged against the cam rollers by force of a spring, a jump phenomenon of the face cam, i.e., separation of a cam surface of the face cam from the cam rollers, occurs when rotational frequency of the rotor, and hence, the face cam, increases. Such a jump phenomenon of the face cam disturbs reciprocation of the plunger, i.e., the pump action of fuel. For this reason, it is difficult to inject fuel at high speed or to increase a rate of injection in the face cam type fuel injection pump. In addition, since the cam surface of the face cam is lubricated by the fuel itself, durability of the cam surface of the face cam is degraded if the fuel is of poor quality.

Unlike the face cam type fuel injection pump described above, since a jump phenomenon of the cam ring is almost never found in the inner cam type fuel injection pump, the inner cam type fuel injection pump is superior to the face cam type fuel injection pump in terms of high speed fuel injection and the rate of injection.

On the other hand, in the inner cam type fuel injection pump, in order to control an injection quantity of fuel injected from the fuel injection pump, the fuel quantity introduced in the pump chamber defined between the above-mentioned plungers is controlled conventionally by a throttle mechanism. The throttle mechanism has a throttle disposed in a passage which communicates the pump chamber with a supply source of fuel, and the size of an opening of the throttle can the pump chamber, i.e., the injection quantity of fuel varies in each injection stroke. Furthermore, since the viscosity of fuel changes in accordance with its temperature, it is difficult to control the injection be adjusted. Therefore, according to such a throttle mechanism, the quantity of fuel introduced into the pump chamber per stroke of the plungers, i.e., the injection quantity of fuel can be adjusted by changing the opening size of the throttle.

However, the quantity of fuel controlled by the above-mentioned throttle mechanism cannot be determined solely by the size of the opening of the throttle, but also depends on a differential pressure between the supply source of fuel and the pump chamber and the viscosity of the fuel. In the inner cam type fuel injection pump, the differential pressure between the supply source of fuel and the pump chamber can be determined by a supply pressure of fuel during introduction of fuel and a residual pressure in the pump chamber immediately after the pressurized fuel is delivered from the pump chamber. However, although the supply pressure of fuel can be easily maintained, the residual pressure of fuel cannot. Therefore, in the inner cam type fuel injection pump, since the differential pressure of fuel between the supply source of fuel and the pump chamber cannot be always maintained during introduction of fuel, an introduction quantity of fuel to the pump chamber, i.e., the injection quantity of fuel varies in each injection stroke. Furthermore, since the viscosity of fuel changes in accordance with its temperature, it is difficult to control the injection quantity of fuel with high accuracy in a inner cam type fuel injection pump.

SUMMARY OF THE INVENTION

It is an object of the present invention to provide a distributor type fuel injection pump which can control the injection quantity of fuel with high accuracy, which can inject the fuel at high speed, and which is suitable for increasing the rate of injection of fuel.

The above object can be achieved by a distributor type fuel injection pump for distributing and supplying pressurized fuel to combustion chambers of an internal combustion engine, comprising: a rotor driven to be rotated; a pair of plungers reciprocated in a radial direction and coaxially with each other in the rotor, the plungers defining a pump chamber therebetween; a shuttle cylinder portion in which a cylinder bore is defined; a shuttle piston movably positioned in the cylinder bore and dividing the interior of the cylinder bore into first and second pressure chambers; connecting means for continuously connecting the pump chamber and the second pressure chamber; supply means for supplying the fuel into the pump chamber and the second pressure chamber through the connecting means and also supplying the fuel into the first pressure chamber, the fuel in the pump chamber and the second pressure chamber being pressurized when the pair of plungers are moved in a direction to reduce a volume of the pump chamber, and the fuel in the first pressure chamber being pressurized when the shuttle piston is moved by the pressure of the pressurized fuel in the second pressure chamber; distribution means for distributing and supplying the pressurized fuel in the first pressure chamber to each combustion chamber of the engine; adjust means for mechanically adjusting an initial position of the shuttle piston in the cylinder bore when the fuel is supplied to the first and second pressure chambers; and spill means for spilling the fuel in the second pressure chamber when the shuttle piston is moved from the initial position in a direction to reduce a volume of the first pressure chamber by the pressure of the pressurized fuel in the second pressure chamber and reaches a predetermined final position in the shuttle cylinder.

According to the distributor type fuel injection pump of the present invention as described above, the fuel in the pump chamber, i.e., the first pressure chamber, can be pressurized by the pair of plungers, the shuttle piston can be moved by the pressure in the second pressure chamber to pressurize the fuel in the first pressure chamber, and then the pressurized fuel in the first pressure chamber can be distributed to eahc cylinder of the engine by the distribution means. In the fuel injection pump of the present invention, supply of the pressurized fuel from the first pressure chamber, i.e., injection of fuel performed by motion of the shuttle piston from its initial to final positions, is terminated when the shuttle piston reaches the final position, i.e., when the fuel in the second pressure chamber is spilled by the spill means. Therefore, in the distributor type fuel injection pump, the injection quantity of fuel is determined by a moving distance of the shuttle piston from its initial to final positions. Thus, by adjusting the initial position of the shuttle piston by the adjust means, the moving distance of the shuttle, i.e., the injection quantity of fuel can be controlled in accordance with a drive condition of the engine.

The fuel injection pump of the present invention controls the quantity of fuel to be injected into the pump chamber, not by using the above-mentioned throttle mechanism, but by the moving distance of the shuttle piston as described above. Therefore, in the fuel injection pump of the present invention, even when the differential pressure between the supply pressure of the supply source of fuel and the residual pressure of the pump chamber varies, this variation in differential pressure does not adversely affect control of the injection quantity of fuel, and a change in viscosity of fuel does not change the injection quantity of the fuel. As a result, according to the present invention, the injection quantity of fuel can be controlled with high accuracy.

DETAILED DESCRIPTION OF THE PREFERRED EMBODIMENTS

Figure 1:
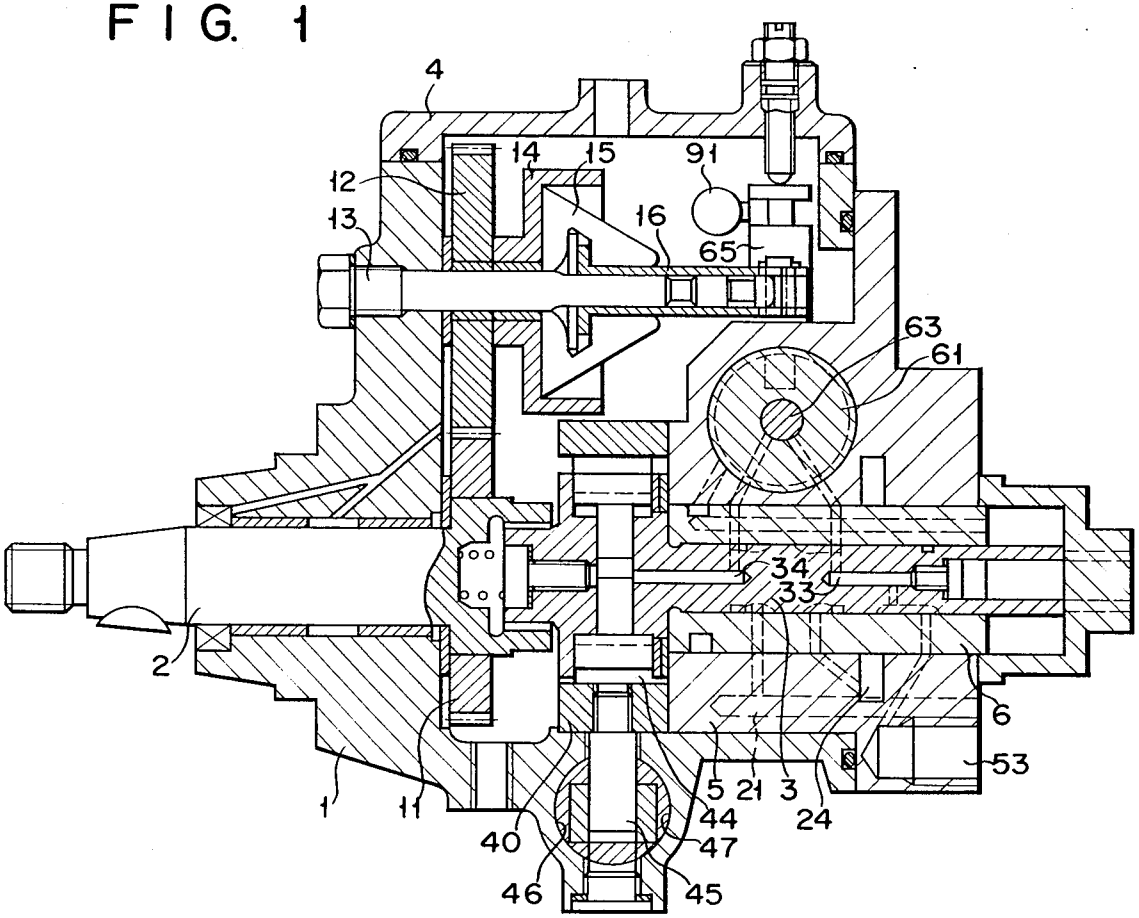
FIG. 1 is a sectional view of a distributor type fuel injection pump according to a first embodiment of the present invention.
Figure 2:
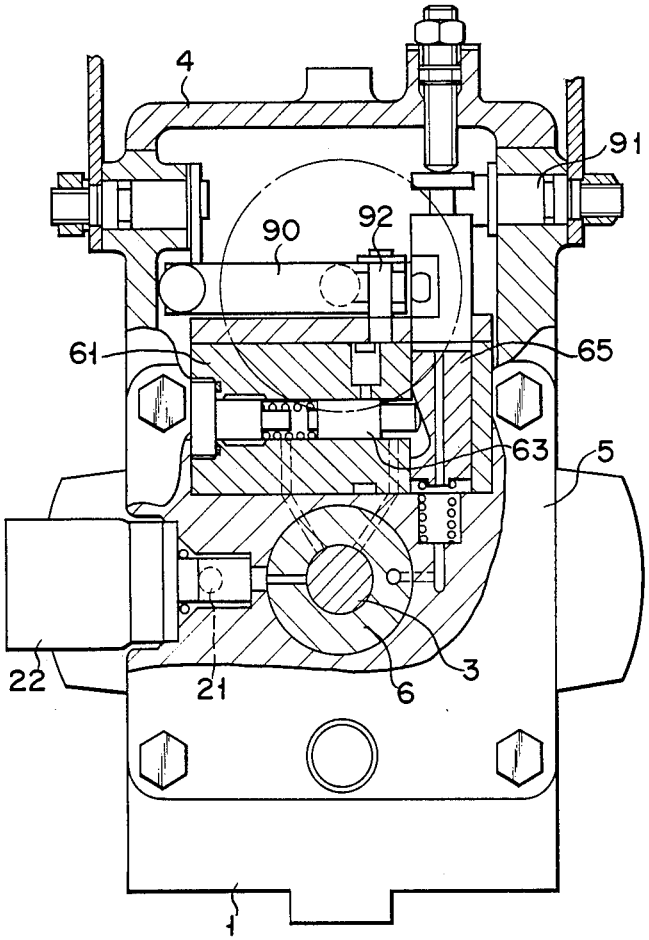
FIG. 2 is a partially cut-away side view of fuel injection pump in FIG. 1.
Figure 3:
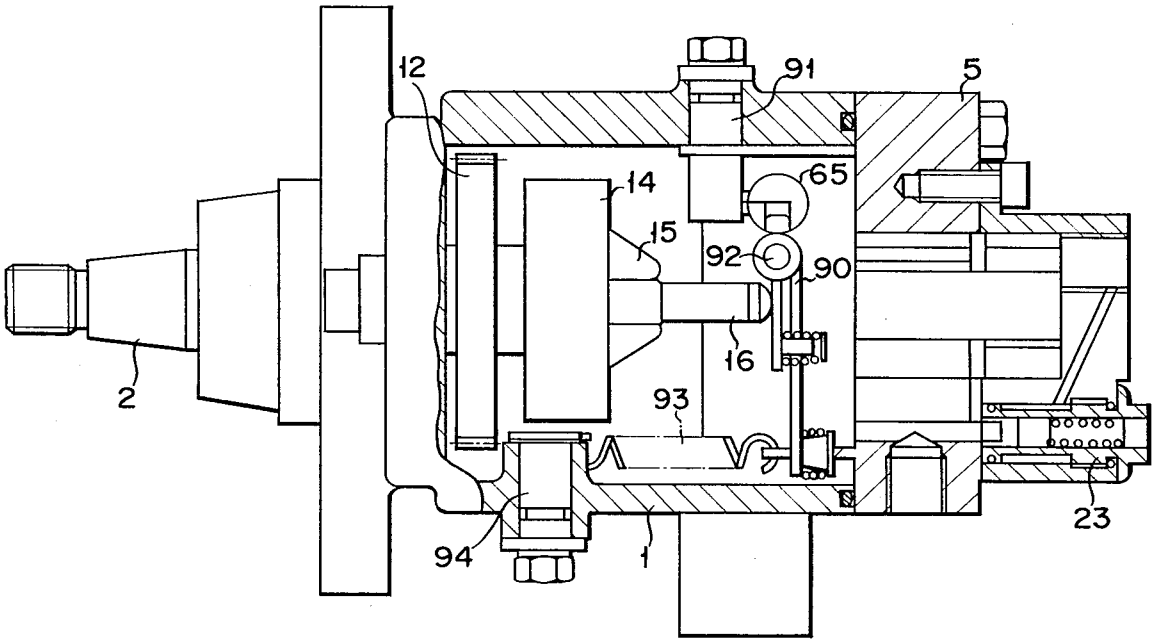
FIG. 3 is a partially cut-away plan view of fuel injection pump in FIG. 1.

A distributor type fuel injection pump, as shown in FIGS. 1 to 3, has pump housing 1. Drive shaft 2 is rotatably supported by one of the walls of housing 1. Shaft 2 is rotated in synchronism with the crankshaft of the engine. Shaft 2 is coupled to rotor 3 in housing 1. Housing cover 4 is liquid-tightly mounted to an upper portion of housing 1.

Distribution head 5 is liquid-tightly mounted to another wall of housing 1 opposite to the wall and has head cylinder 6 therein.

Rotor 3 is concentrically and rotatably inserted in cylinder 6 and is coupled to shaft 2 to be rotated therewith.

Drive gear 11 is mounted to a portion of shaft 2 located inside housing 1. Driven gear 12 is meshed with gear 11. Gear 12 is mounted to main shaft 13 of the governor. In addition, flyweights 15 are mounted to shaft 13 through holder 14. By rotation of gear 12, flyweights 15 together with holder 14 are rotated, and flyweights 15 are displaced radially and outwardly by a centrifugal force. Then, governor sleeve 16 is moved in the axial direction of shaft 13 by the displacement of flyweights 15. Sleeve 16 rotates a pivot lever in accordance with the rotational frequency of the engine as will be described later.

Feed passage 21 is formed in head 5, and fuel is supplied to passage 21 from a feed pump (not shown). Valve 22 for stopping the supply of fuel is provided to passage 21 (FIG. 2). Passage 21 communicates with regulate valve 23 (FIG. 3), and a pressure of fuel supplied to passage 21 is maintained at a constant pressure by valve 23.

Annular feed groove 24 is formed in head 5 to surround cylinder 6, and groove 24 communicates with passage 21.

Figure 4:
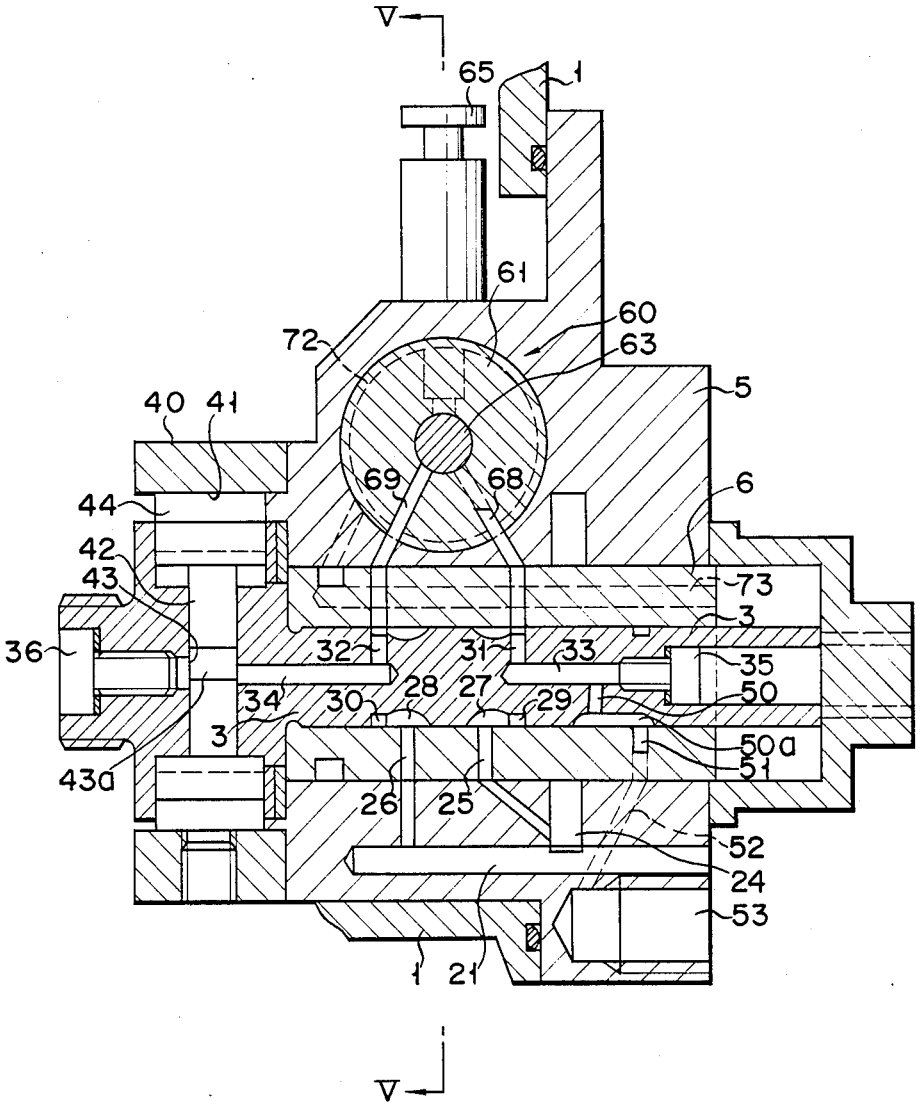
FIG. 4 is an enlarged view of a part of fuel injection pump in FIG. 1.

As shown in FIG. 4, first and second supply holes 25 and 26 are formed in cylinder 6 and are spaced apart from each other along the axial direction of cylinder 6. Radial inner ends of holes 25 and 26 are respectively opened to the inner surface of cylinder 6 in which rotor 3 is inserted. Radial outer ends of holes 25 and 26 communicate with groove 24 and passage 21, respectively.

Figures 6, 7:
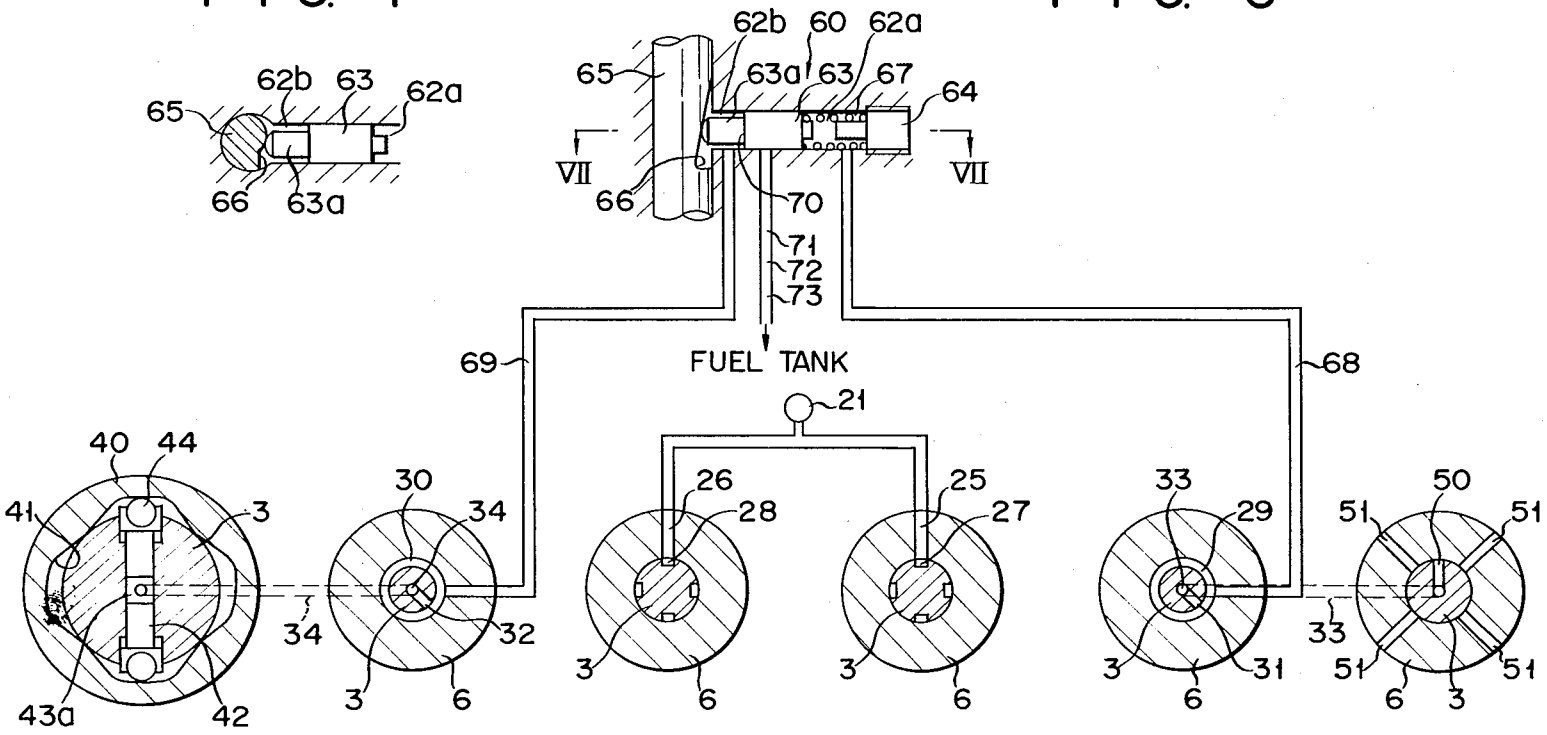
FIG. 6 is a view for explaining a fuel system of the fuel injection pump in FIG. 1.
FIG. 7 is a sectional view taken along the line VII—VII in FIG. 6.

First and second inlet ports 27 and 28 are respectively formed on the outer surface of rotor 3 and spaced apart from each other along the axial direction of rotor 3. First and second inlet ports 27 and 28 can be connected to holes 25 and 26. Ports 27 and 28 are provided in a number equal to the number of cylinders of the engine and disposed at equal intervals along the circumference of rotor 3 (FIG. 6). Ports 27 and 28 are sequentially communicated with corresponding holes 25 and 26 during rotation of rotor 3. In this case, one of ports 27 communicates with hole 25 and at the same time, one of ports 28 communicates with hole 26. Each of ports 27 and 28 is formed as a groove parallel to the axis of rotor 3. In addition, ports 27 and 28 communicate with annular grooves 29 and 30 formed on the outer surface of rotor 3, respectively. Grooves 29 and 30 are communicated with fuel supply passage 33 and pumping passage 34 formed in rotor 3, respectively through communication passages 31 and 32. Supply passage 33 and pumping passage 34 are arranged concentrically with respect to the axis of rotor 3 and independently from each other. Passages 33 and 34 are axially provided from both end surfaces of rotor 3, and opened ends of passages 33 and 34 are closed liquid-tightly by plugs 35 and 36, respectively.

The end portion of rotor 3, where passage 34 is formed, projects into housing 1 from head 5. This projection of rotor 3 is surrounded by cam ring 40.

Cam ring 40 is located adjacent to the inner end of head 5 and, although not shown in detail, supported to be rotatable about the axis of rotor 3 with respect to the inner surface of housing 1. As shown in FIG. 6, wave-shaped cam surface 41 is formed circumferentially on the inner surface of cam ring 40. Cam ridges of surface 41 are formed in a number equal to the number of the cylinders of the engine and disposed circumferentially at equal intervals.

Cylinder bore 43 extends diametrically through the projected end of rotor 3 surrounded by ring 40, and a pair of plungers 42 are inserted in bore 43. The outer end of each plunger 42 is coupled to a roller shoe slidably inserted in bore 43, like plunger 42. Each roller shoe rotatably holds cam roller 44, and each cam roller rotatably contacts surface 41 of cam ring 40. When plungers 42 are pushed in rotor 3, in synchronism with an action of the cam ridge of surface 41, fuel in pump chamber 43*a* defined between the inner ends of plungers 43 is pressurized. Chamber 43*a* communicates with passage 34 so that the pressurization of fuel in pump chamber 43*a* acts on the fuel in passage 34.

In addition, cam ring 40 is coupled to pin 45, as shown in FIG. 1, and pin 45 is coupled to timer piston 46. Piston 46 is slidably fitted in timer cylinder bore 47 formed in housing 1. As is apparent from FIG. 1, the axis of bore 47 is perpendicular to that of cam ring 40. When the fuel, the pressure of which can be controlled in accordance with the drive condition of the engine, is supplied to a working chamber (not shown) defined by piston 46 in bore 47, piston 46 is subjected to the pressure of fuel and is moved in a direction perpendicular to the axis of cam ring 41. As a result, cam ring 40 is rotated about its axis, and the position of the phase angle of surface 41 is circumferentially displaced, so that the timing of the pump action by reciprocation of plungers 42 is advanced or delayed. Accordingly, the injection timing of fuel can be controlled.

In addition, distribution hole 50 which communicates with passage 33 is formed in the other end portion of rotor 3, i.e., a portion where passage 33 is formed. Hole 50 is connected to distribution port 50*a* opened on the outer surface of rotor 3. On the other hand, delivery holes 51 can be connected to port 50*a* and are formed in the same number as that of cylinders of the engine. Holes 51 are distributed radially and uniformly in cylinder 6. Port 50*a* sequentially communicates with respective holdes 51 along with the rotation of rotor 3. In this case, when ports 27 and 28 and corresponding holes 25 and 26 are disconnected, port 50*a* communicates with one of holes 51. However, in FIG. 4, ports 27 and 28 are connected to holes 25 and 26 when port 50*a* is connected to hole 51, for drawing convenience.

Each hole 51 is connected to each combustion chamber of the engine through delivery passage 52 and delivery valve 53 disposed in passage 52.

Figure 5:
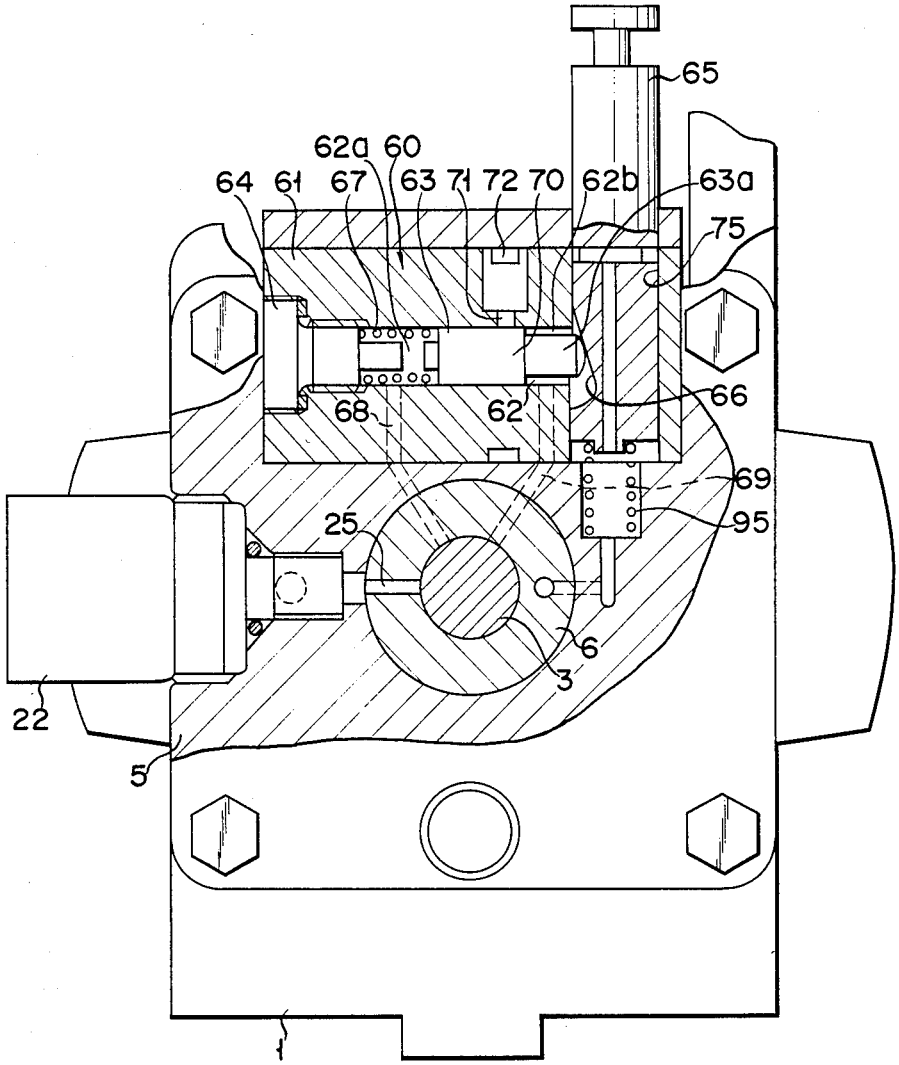
FIG. 5 is a sectional view taken along the line V—V in FIG. 4.

Furthermore, shuttle mechanism 60 is provided to head 5. Mechanism 60 will be described below. Shuttle cylinder 61 is arranged in head 5 in a direction perpendicular to the axis of rotor 3. As shown in FIG. 5, cylinder bore 62 is formed in cylinder 61 on the axis perpendicular to the axis of rotor 3. Shuttle piston 63 is slidably fitted in bore 62 to divide it into first and second pressure chambers 62*a* and 62*b*. Volumes of chambers 62*a* and 62*b* are changed by the axial motion of piston 63. Chamber 62*a* is defined between an end surface of piston 63 and plug 64 liquid-tightly inserted in bore 62, and chamber 62*b* is defined between the other end surface of piston 63 and control rod 65 inserted in cylinder 61 to be perpendicular to the axis of piston 63.

Rod 65 is liquid-tightly fitted in hole 75 formed in cylinder 61 to be movable along its axis and rotatable thereabout. Cam surface 66 is provided on the outer surface of rod 65 and defined by a bottom surface of a groove formed in the outer surface of rod 65, as shown in FIG. 5. The depth of surface 66, i.e., the bottom surface of the groove, is gradually changed along the axis of rod 65, and is, as shown in FIG. 7, changed circumferentially with respect to rod 65. The other end surface of piston 63, i.e., pin 63*a* projecting from piston 63, slidably abuts against surface 66 having the above-mentioned profile. The distal end of pin 63*a* is formed to be round. Piston 63 is urged against rod 65 by spring 67 housed in chamber 62*a*.

Chambers 62*a* and 62*b* of mechanism 60 are connected to grooves 29 and 30 formed in rotor 3, respectively, through fuel passages 68 and 69 formed in cylinder 61 and head 5. Accordingly, chambers 62*a* and 62*b* always communicate with passages 33 and 34, respectively.

In addition, spill hole 71 is formed in cylinder 61. Hole 71 is closed by the outer surface of piston 63 in a state shown in FIG. 5. When piston 63 is moved from the state shown in FIG. 5 along a direction to reduce the volume of chamber 62*a*, hole 71 is opened by spill lead 70 formed by a step surface of piston 63 and thus connected to chamber 62*b*.

Furthermore, hole 71 communicates with annular groove 72 formed in the outer surface of cylinder 61 and is connected to passage 73 or fuel tank (not shown) through annular groove 72 and spill passage 73 (schematically shown in FIG. 6).

The upper end of rod 65 projects from the upper surface of head 5 and, as shown in FIGS. 1 and 3, is connected to pivot lever 90 and full load shaft 91, respectively. Lever 90 is mounted to support shaft 92 rotatably projecting from the upper surface of head 5, as shown in FIG. 3, and is pivoted about shaft 92 along with the motion of sleeve 16 described above. When shaft 92 together with lever 90 are pivoted by the motion of sleeve 16, the rotation of shaft 92 is transferred to rod 65 so that rod 65 is rotated about its axis.

It should be noted that as shown in FIG. 3, lever 90 is biased by spring 93 to abut against sleeve 16. The biasing force of spring 93 can be adjusted by shaft 94.

Shaft 91 is rotatably mounted to housing 1 and coupled to, e.g., an accelerator pedal of an automobile through a coupling mechanism (not shown). Therefore, shaft 91 can be rotated in accordance with a depressed amount of the accelerator pedal. By rotation of shaft 91, rod 65 can be displaced along its axis. It should be noted that spring 95, shown in FIG. 5, serves to return rod 65 to a predetermined position along its axis, i.e., an initial position.

An operation of fuel injection pump of the first embodiment is as follows.

When rotor 3 is rotated by a rotational force from drive shaft 2 and one of first and second inlet ports 27 and 28 communicates with a corresponding one of first and second supply holes 25 and 26, as shown in FIG. 6, distribution port 50*a* is not connected to any of delivery holes 51, i.e., port 50*a* is closed.

In this state, fuel from feed passage 21 is supplied to fuel supply passage 33 and pumping passage 34 through one of holes 25 and 26 and a corresponding one of ports 27 and 28, and through annular grooves 29 and 30 and communication passages 31 and 32.

When the fuel is supplied from port 28 to passage 34, a pair of plungers 42 are urged outwardly in the radial direction, and hence cam rollers 44 are moved and brought into contact with cam surface 41 of cam ring 40.

Passages 33 and 34 communicate with first and second pressure chambers 62a and 62b of shuttle mechanism 60 through fuel passages 68 and 69, respectively. When the fuel is supplied from passage 21 to passages 33 and 34, the fuel is also supplied to chambers 62a and 62b. At this time, because the fuel supplied to chamber 62a has the same pressure as that of fuel supplied to chamber 62b, shuttle piston 63 is subjected to the force of spring 67 and urged against control rod 65. As a result, spill hole 71 is closed by spill lead 70 of piston 63, and pin 63a of piston 63 abuts against cam surface 66 of rod 65.

When rotor 3 is rotated by a predetermined angle, holes 25 and 26 are disconnected from ports 27 and 28 respectively. However, passages 33 and 34 of rotor 3 still communicate with chambers 62a and 62b of mechanism 60 respectively by corresponding communication passages 31 and 32 and grooves 29 and 30 through fuel passages 68 and 69. When rotor 3 is further rotated by a predetermined angle, rollers 44 of rotor 3 respectively ride over cam ridges of cam surface 41, and hence plungers 42 are urged inwardly along the radial direction of rotor 3, thereby pressurizing the fuel in pump chamber 43a and passage 34. At the same time, since passage 34 communicates with chamber 62b, the fuel in chamber 62b is also pressurized. The high-pressure fuel in chamber 62b urges piston 63 in a direction to reduce the volume of chamber 62a. Therefore, the fuel in the passage between chamber 62a and passage 33 is pressurized to obtain high pressure. Thereafter, when port 50a communicates with one of delivery holes 51 as rotor 3 rotates, the high-pressure fuel in the passage between chamber 62a and passage 33 is delivered from hole 51 connected to port 50a through this port 50a and then injected to the combustion chamber of the engine through delivery passage 52 and delivery valve 53.

In such an injection process of fuel, when piston 63 is further moved in a direction to reduce the volume of chamber 62a and hole 71 is opened by lead 70 of piston 63, the high-pressure fuel in chamber 62b is spilled either to passage 73 or to the fuel tank by hole 71 through annular groove 72 and spill passage 73. Therefore, the pressure of fuel in chamber 62b is suddenly decreased and at the same time, the pressure of fuel in chamber 62a is also decreased, so that the injection process of fuel described above is terminated.

In addition, by repeating the above operation along with rotation of rotor 3, the fuel is drawn into chambers 62a and 62b of mechanism 60 and then pressurized, so that the fuel in the passage between chamber 62a and passage 33 is distributed and supplied to each combustion chamber of the engine.

In this case, the quantity of fuel injected into the combustion chamber of the engine corresponds to a moving distance of piston 63 from its initial position where piston 63 contacts surface 66 of rod 65 to its final position where hole 71 is opened.

Surface 66 of rod 65 has the shape described above, and rod 65 can be rotated about its axis by motion of governor sleeve 16 in accordance with the rotational frequency of the engine and can be displaced along its axis by shaft 91 which is rotated in accordance with a depressed amount of the accelerator pedal. Therefore, since rod 65 is moved axially in accordance with the driving condition of the engine and is rotated about its axis, the initial position of piston 63 can be controlled in accordance with the driving condition of the engine by an action of surface 66 of rod 65. Thus, the injection quantity of fuel can be controlled in accordance with the driving condition of the engine because the stroke of piston 63 can be adjusted.

In addition, since cam ring 40 is coupled to piston 46 through pin 45, when the fuel, the pressure of which is controlled in accordance with the driving condition of the engine, is introduced in the working chamber of timer cylinder 47, piston 46 can be moved by the pressure of fuel to displace the rotational position of cam ring 40. Therefore, the cam ridges of cam surface 41 are changed along the circumferential direction of ring 40, and hence the timing of the pump action by reciprocation of plungers 42 is either advanced or delayed. For this reason, the timing of fuel pressurization in passage 34 is controlled, i.e., the timing of fuel pressurization in chamber 62b is controlled, so that the timing of fuel injection is controlled. Therefore, according to the fuel injection pump of the above first embodiment, since a throttle mechanism need not be provided to passage 21 to control the injection quantity of fuel, problems posed by use of the throttle mechanism can be eliminated. Therefore, according to the fuel injection pump of the present invention, the injection quantity of fuel can be controlled with high accuracy by adjusting the stroke of piston 63.

Figure 8:
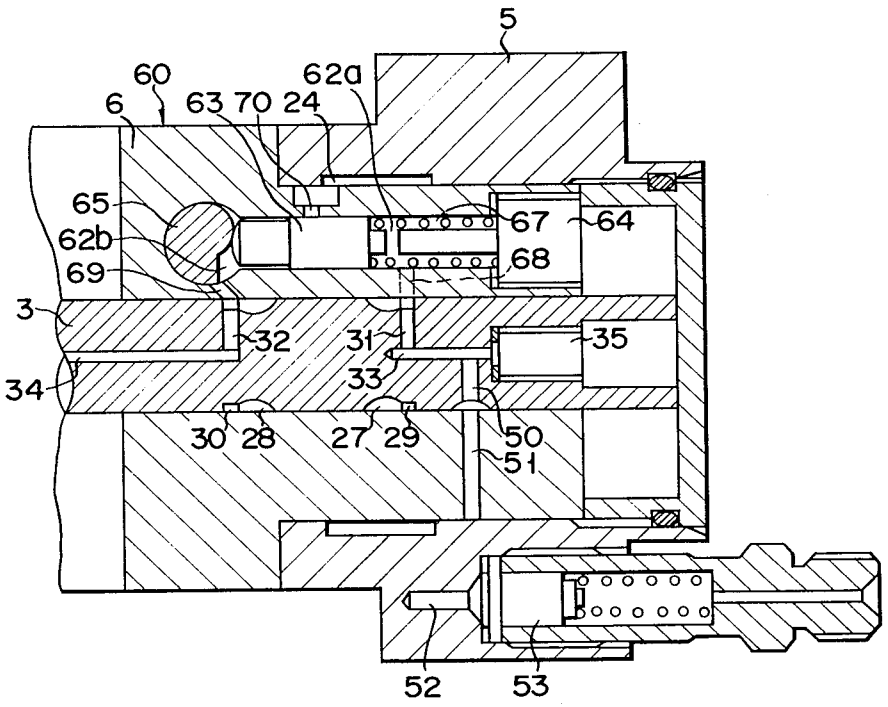
FIG. 8 is a sectional of a part of a distributor type fuel injection pump according to a second embodiment of the present invention.
Figure 9:
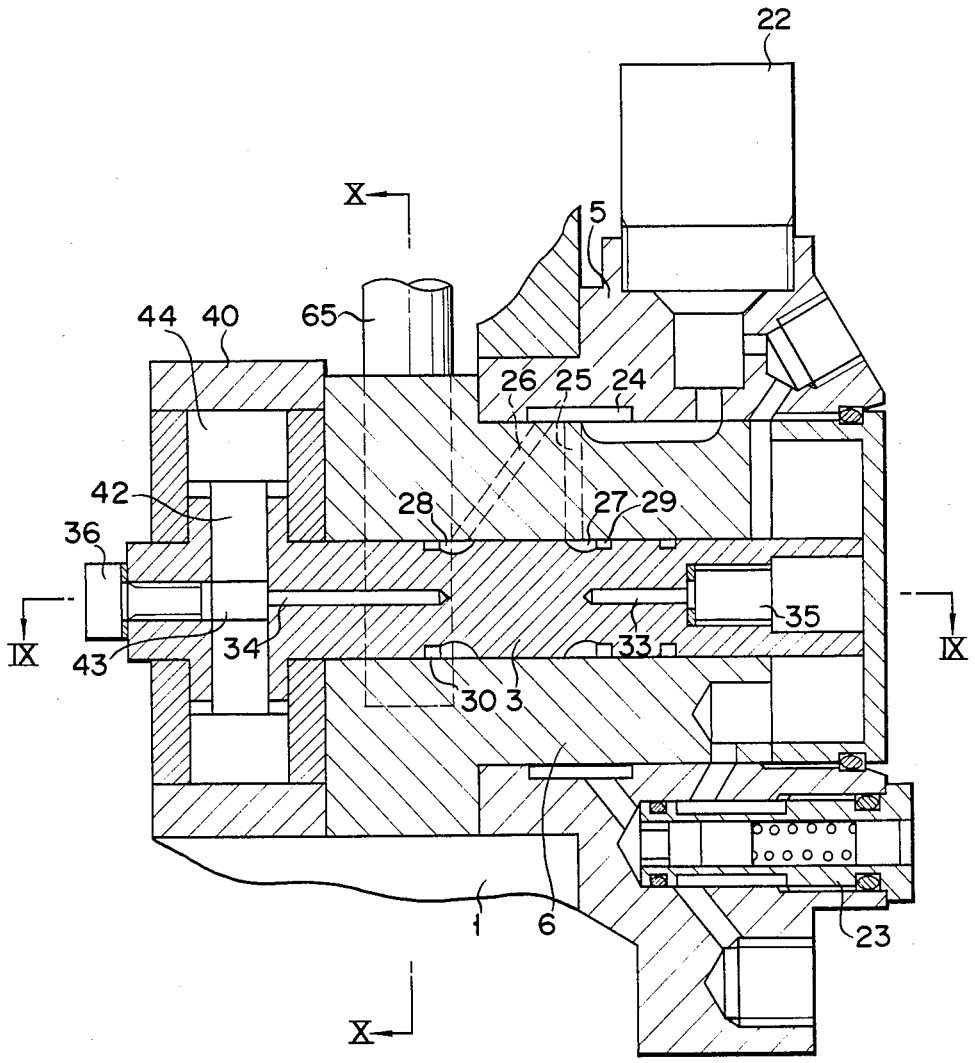
FIG. 9 is a sectional view taken along the line IX—IX in FIG. 8.
Figure 10:
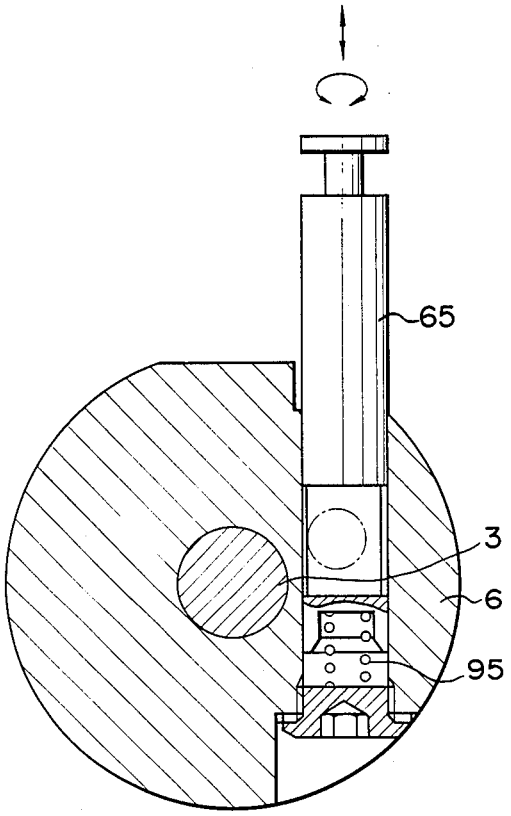
FIG. 10 is a sectional view taken along the line X—X in FIG. 8.

In the above first embodiment, the description has been made with reference to shuttle mechanism 60 obtained by disposing shuttle cylinder 61 in distribution head 5 along a direction perpendicular to the axis of rotor 3. However, the present invention is not limited to such mechanism 60. Referring to FIGS. 8 to 10, a second embodiment of the present invention is shown. Mechanism 60 of the second embodiment is provided in head cylinder 6, and cylinder 61 of mechanism 60 is disposed parallel to the axis of rotor 3. Since the other structure of the second embodiment is the same as that of the first embodiment, the same parts are denoted by the same reference numerals and a description thereof will be omitted.

In addition, means for mcving control rod 65 along its axis and displacing it about its axis is not limited to the one including governor sleeve 16 and full load shaft 91 which is rotated in accordance with the depressed amount of the accelerator pedal, but a hydraulic or electromagnetic governor may be used to operate rod 65 in accordance with the driving condition of the engine.

What is claimed is:

1. A distributor type fuel injection pump for distributing and supplying pressurized fuel into combustion chambers of an internal combustion engine, comprising:

a rotor driven to be rotated;

a pair of plungers slidably reciprocated in a radial direction and coaxially with each other in the rotor, the plungers defining a pump chamber therebetween;

a shuttle cylinder portion in which a cylinder bore is defined;

a shuttle piston movably disposed in the cylinder bore and dividing the interior of the cylinder bore into first and second pressure chambers;

connecting means for continuously connecting the pump chamber and the second pressure chamber;

supply means for supplying the fuel into the pump chamber and the second pressure chamber through the connecting means and also supplying the fuel into the first pressure chamber, the fuel in the pump chamber and the second pressure chamber being pressurized when the pair of plungers are moved in a direction to reduce a volume of the pump chamber, and the fuel in the first pressure chamber being pressurized when the shuttle piston is moved by the pressure of the pressurized fuel in the second pressure chamber;

distribution menas for distributing and supplying the pressurized fuel in the first pressure chamber to each combustion chamber of the engine;

a spring located in the first pressure chamber for urging the shuttle piston towards the second pressure chamber;

a pin projecting from one end of the shuttle piston defining the second pressure chamber; and an adjust member having an abut surface against which the distal end of the pin abuts and being movable along an axis of the shuttle piston, and pin cooperating with said adjust member to adjust an initial position of said shuttle piston in the cylinder bore when fuel is supplied to the first and second pressure chambers; and spill means for spilling the fuel in the second pressure chamber when the shuttle piston is moved from the initial position in a direction to reduce a volume of the first pressure chamber by the pressure of the pressurized fuel in the second pressure chamber and reaches a predetermined final position in the cylinder bore.

2. A pump according to claim 1, wherein the spill means includes a spill hole formed in the shuttle cylinder portion and opened into the cylinder bore, the opening of the spill hole to cylinder bore is closed by the shuttle piston itself when the shuttle piston is in the initial position and is opened by a spill lead formed by the boundary between the shuttle piston and the pin when the shuttle piston is located at the final position, thereby communicating the spill hole with the second pressure chamber.

3. A pump according to claim 1, wherein the rotor and the shuttle piston are arranged so that their axes are perpendicular to each other.

4. A pump according to claim 1, wherein the rotor and the shuttle piston are arranged so that their axes are parallel to each other.

5. A pump according to claim 1, wherein the adjust member is a control rod disposed in the shuttle cylinder portion to be slidable along a direction perpendicular to the axis of the shuttle piston, and an abut surface of control rod defines a part of a boundary of the second pressure chamber and is an inclined surface inclined along the axis of the control rod, thereby axially moving the control rod to adjust the initial position of the shuttle piston.

6. A pump according to claim 5, wherein the control rod is rotatable about its axis and the abut surface of the control rod has a predetermined curved surface along a circumferential direction of the control rod.

7. A pump according to claim 6, wherein the distal end of the pin of the shuttle piston is formed to be round.

* * * * *